US008932085B2

(12) United States Patent
Fang et al.

(10) Patent No.: US 8,932,085 B2
(45) Date of Patent: Jan. 13, 2015

(54) ELECTRICAL CONNECTOR WITH A SPACER FOR RETAINING CONTACTS THEREON

(71) Applicant: Hon Hai Precision Industry Co., Ltd., New Taipei (TW)

(72) Inventors: Ai-Hong Fang, Kunshan (CN); Hua Li, Kunshan (CN); Huo-Xing Jin, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/958,528

(22) Filed: Aug. 2, 2013

(65) Prior Publication Data

US 2014/0038468 A1 Feb. 6, 2014

(30) Foreign Application Priority Data

Aug. 3, 2012 (CN) ..... 2012 1 0274467

(51) Int. Cl.
*H01R 24/00* (2011.01)
*H01R 13/405* (2006.01)
*H01R 12/72* (2011.01)

(52) U.S. Cl.
CPC ..... *H01R 13/405* (2013.01); *H01R 12/724* (2013.01)
USPC ..... 439/676

(58) Field of Classification Search
USPC ..... 439/676, 660, 78–84, 374, 381, 733, 439/751, 695, 701, 686
See application file for complete search history.

(56) References Cited

U.S. PATENT DOCUMENTS 7,473,133 B1 * 1/2009 Zhang ..... 439/607.01
7,988,462 B2 * 8/2011 Mao et al. ..... 439/79
8,052,487 B2 * 11/2011 Zhu ..... 439/695

FOREIGN PATENT DOCUMENTS

TW M426190 4/2012

* cited by examiner

*Primary Examiner* — Edwin A. Leon
(74) *Attorney, Agent, or Firm* — Wei Te Chung; Ming Chieh Chang

(57) ABSTRACT

An electrical connector includes an insulative housing a front opening cavity a front-to-back direction, a plurality of contacts retained in the insulative housing and a spacer attached to the insulative housing. Each of the contacts incudes a contacting portion exposed in the cavity, a soldering portion protruding from the insulative housing and a bridge portion connecting with the contacting portion and the soldering portion. A first row of the solder portions of the contacts extend rearward and a second row of soldering portions of the contacts extend forwards. The spacer has a horizontal section under the insulative housing and a vertical section at back of the insulative housing to press against the bridge portions of the second contacts.

18 Claims, 4 Drawing Sheets

ELECTRICAL CONNECTOR WITH A SPACER FOR RETAINING CONTACTS THEREON

BACKGROUND OF THE INVENTION

1. Field of the Invention

The present invention relates to an electrical connector with SMT solder portions of contacts.

2. Description of Related Art

Electrical connector is widely used in electronic field, such as personal computer. Taiwan Utility Patent Issued No. M426190 discloses an electrical connector, which includes an insulative housing, several contacts received in the insulative housing and a metallic shell shielding the insulative housing. Each contact includes a contacting portion, a retaining portion and a through-hole type soldering portion. A spacer is provided and defines several through holes through which said soldering portions pass to position the soldering portions. However, the spacer couldn't be applied to soldering portions of complex arrangement, especially an electrical connector soldered by surface-mounting technology.

Hence, an electrical connector with a new spacer is desired.

BRIEF SUMMARY OF THE INVENTION

Accordingly, an object of the present invention is to provide an electrical connector with a spacer.

To achieve the above object, an electrical connector comprises an insulative housing a front opening cavity a front-to-back direction, a plurality of contacts retained in the insulative housing and a spacer attached to the insulative housing. Each of the contacts comprises a contacting portion exposed in the cavity, a soldering portion protruding from the insulative housing and a bridge portion connecting with the contacting portion and the soldering portion. A first row of the solder portions of the contacts extend rearward and a second row of soldering portions of the contacts extend forwards. The spacer comprises a horizontal section under the insulative housing and a vertical section at back of the insulative housing to press against the bridge portions of the second contacts.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
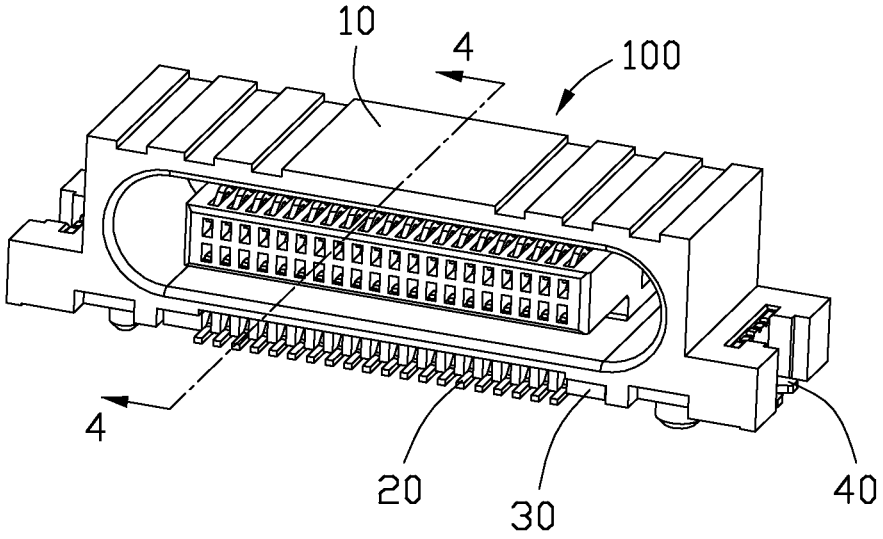
FIG. 1 is a perspective view of an electrical connector according to a preferred embodiment of the present invention.

Reference will now be made to the drawing figures to describe the preferred embodiment of the present invention in details. FIGS. 1~4 illustrate an electrical connector 100 according to the present invention. The electrical connector 100 comprises an insulative housing 10, several contacts 20 retained in the insulative housing and an insulative spacer 30 attached to the insulative housing.

Figure 2:
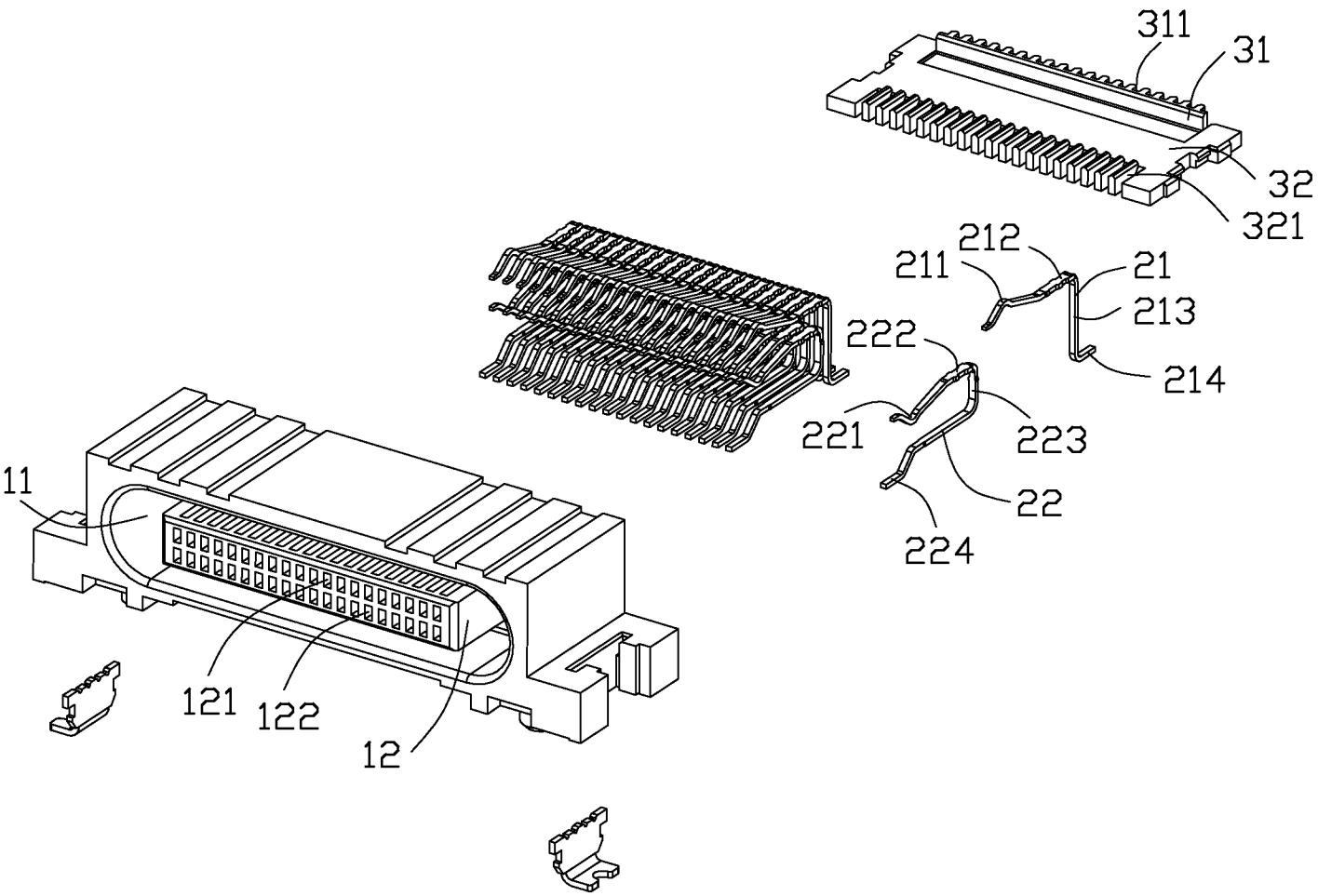
FIG. 2 is an exploded view of the electrical connector as shown in FIG. 1.
Figure 3:
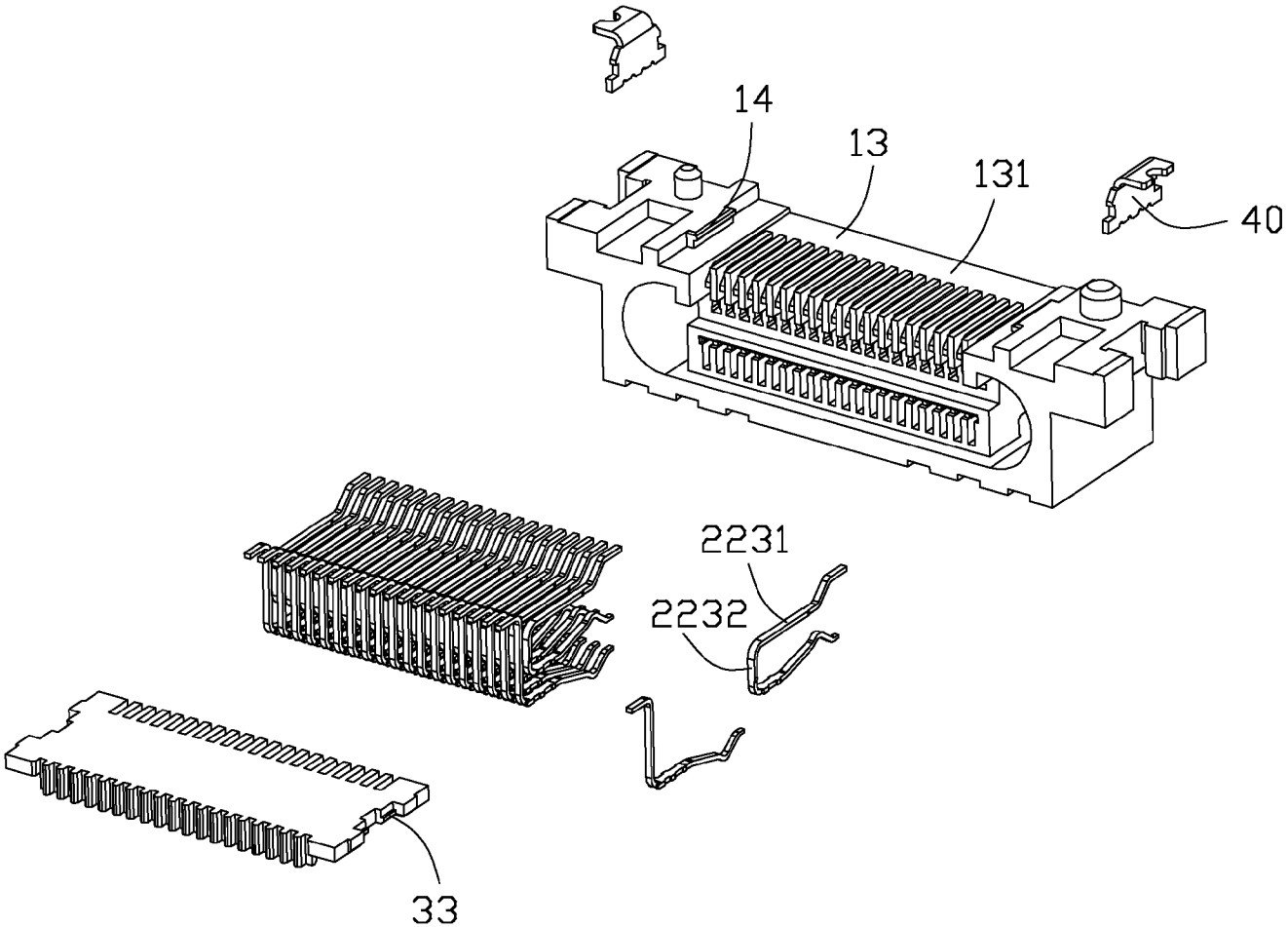
FIG. 3 is another exploded view of the electrical connector as shown in FIG. 1.
Figure 4:
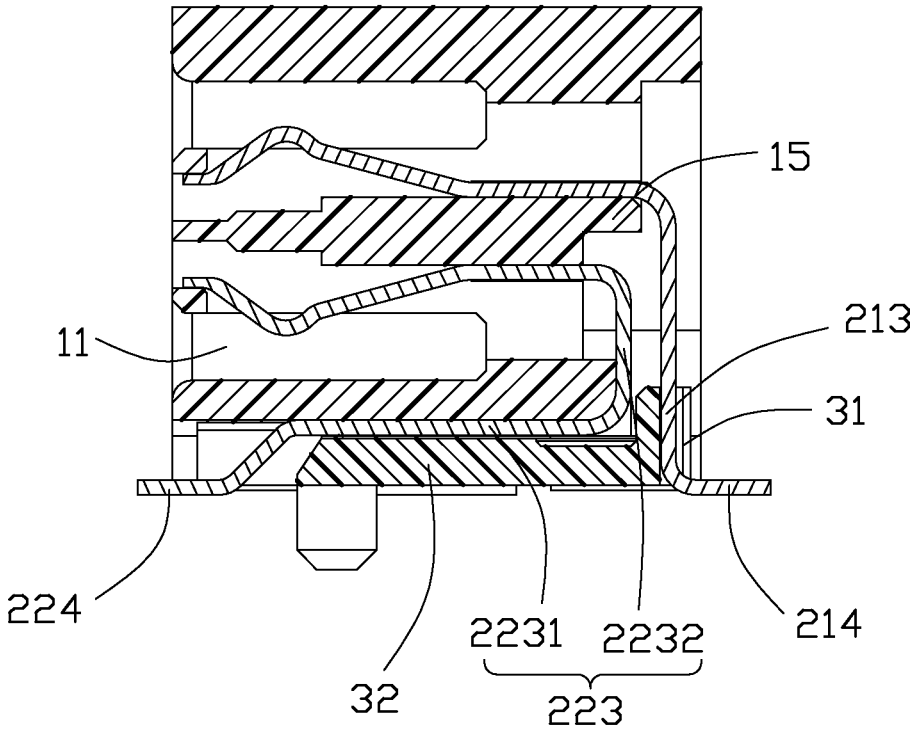
FIG. 4 is a cross sectional view of the electrical connector taken along lines 4-4 in FIG. 1.

Referring to FIGS. 2~3, the insulative housing is rectangular and defines a front opening cavity 11 along a front-to-back direction and a mating tongue 12 extending in the cavity 11 along the front-to-back direction from a rear wall 15 as best shown in FIG. 4. The mating tongue 12 defines a row of upper passageways 121 and a row of lower passageways 122 extending along the front-to-back direction. Please notes, the first and second passageways extend from a front face of the mating tongue 11 through the rear wall 15 and the bottom (i.e., mounting face) of the insualtive housing.

The contacts 20 are divided to a row of first contacts 21 and a row of second contacts which are received in said upper passageways 121 and said lower passageways 122 respectively. Each contact of the first contacts and second contacts comprises a contacting portion 211/221, a retaining portion 212/222 at a rear end of the contacting portion, a bridge portion 213/223 bending perpendicularly from the retaining portion and a soldering portion 214/224 formed at the free end of the bridge portion. The contacting portions 211 of the first contacts 21 are received in the upper passageways 121 and partially exposed to the top face of the mating tongue 12 while the contacting portions 212 of the second contacts are received in the lower passageways 122 and partially exposed to the bottom surface of the mating tongue.

Combining with FIGS. 2 and 4, the insulative housing 10 defines a depression 13 under the cavity 11 at the bottom of the housing with an inner face 132. The spacer 30 is assembled to the depression 13 of the insulative housing from bottom to top. The spacer 30 includes a main large horizontal section 32 and a short vertical section 31 perpendicularly from a rear edge of the vertical section 32. The vertical section 31 defines several first slots 311 vertically along a rear face thereof and the horizontal section 32 defines several second slots 321 along a front edge thereof The first slots 311 are perpendicular to the second slots 321. Each first or second slot is defined by a pair of parallel and partitioned protrudes. Said first slot 311 is spaced apart from the second slot 321 with a distance, the distance is larger than thickness of the vertical section 31 along said front-to-back direction. The insulative housing 10 includes a pair of first locking portions 14 at both ends of the depression 13. The spacer 30 has a pair of second locking portions 33, which are inter-engaged with the first locking portions 14 so as to assemble the spacer 30 to the insulative housing 10.

Referring to FIG. 4, the contacts 20 are firstly assembled to the depression 13 of the housing. The bridge portions 213 of the first contacts 21 are received in the first passageways and exposed to a rear face of the housing. The bridge portions 223 includes horizontal portions 2231 received in the second passageways and exposed to the rear face of the housing and vertical portions 2232 are received in the second passageways and exposed to the inner face 131. The soldering portions 214 of the first contacts bend rearward and horizontally and the solder portion 224 of the second contacts extend forwards and bend slantwise and downwards, so that said soldering portions are parallel to a bottom of the insulative housing and adapter for SMT (surface mounted technology) soldering method. When the spacer 30 is attached to the depression 13, the horizontal portion 32 are just received in the depression 13 and abut against the inner face 131, the horizontal portions 2231 are received in the second slots, so that the horizontal portions 321 are snugly clipped between the inner face 132 and the horizontal portion of the spacer. The vertical portions 2232 of the bridge portions of the second contacts 22 are snugly clipped between the rear face of the housing and the front face of the vertical portion 31 of the spacer 30. The bridge portions of the first contacts 21 are received in the second slots 321 defined on the vertical portion, which is located apart from bridge portion 223 of the second contacts by the vertical section of the spacer 30, thereby avoiding short circuit of said two bridge portions. The first and second slots are helpful to improve planeness between the first and second contacts. The first slots of the vertical portion of the spacer 30 are shorter than the vertical portion of the bridge portions of the second contacts.

It is remarkable that solder portions 214, 224 are located at different sides of the insulative housing 10, which is convenient and easy to be soldered. The spacer 30 and the posts 15 are used to mechanically connect the electrical connector 100 to a printed circuit board (not shown).

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining a front opening cavity, a mating front extending forwards in the cavity and a mounting face;

a row of first contacts, the first contacts comprising contacting portions disposed on top face of the mating tongue, soldering portions disposed on a rear side of a mounting face along a front to rear direction and bridge portions connecting with the contacting portions and the soldering portions, the bridge portion being disposed along a rear face of the housing;

a row of second contacts, the second contacts comprising contacting portions disposed on bottom face of the mating tongue, soldering portions disposed on a front side of the mounting face and bridge portions connecting with the contacting portions and the soldering portions, the bridge portion comprising a vertical portion disposed along the rear face of the housing and a horizontal portion disposed along the mounting face of the housing; and a spacer attached to the mounting face of the insulative housing;

wherein the spacer comprises a main horizontal portion snugly attached to the mounting face and a vertical portion snugly attached the rear face of the housing so that the horizontal portions of the second contacts are clipped between the mounting face and the horizontal portion and the vertical portion of the spacer are located between and separate the horizontal portions of the second contacts and the bridge of the first contacts.

2. The electrical connector as claimed in claim 1, wherein the vertical portion of the spacer defines first slots at a rear face thereof to receive the bridge portions of the first contacts.

3. The electrical connector as claimed in claim 2, wherein the horizontal portion of the spacer defines second slots along a rear edge there, through which the soldering portions of the second contacts run.

4. The electrical connector as claimed in claim 1, wherein the first slots are disposed apart from the second slots with a distance which is larger than thickness of the vertical section along the front to back direction.

5. The electrical connector as claimed in claim 2, wherein the insulative housing also defines a depression at the mounting face, the horizontal portion of the spacer is received in the depression.

6. An electrical connector comprising:

an insulative housing a front opening cavity along a front-to-back direction;

a plurality of contacts retained in the insulative housing and each of the contacts comprising a contacting portion exposed in the cavity, a soldering portion protruding from the insulative housing and a bridge portion connecting with the contacting portion and the soldering portion; and a spacer attached to the insulative housing;

wherein a first row of the solder portions of the contacts extend rearward and a second row of soldering portions of the contacts extend forwards;

wherein the spacer comprises a horizontal section under the insulative housing and a vertical section at back of the insulative housing to press against the bridge portions of the second contacts.

7. An electrical connector for mounting to a printed circuit board, comprising:

an insulative housing defining opposite front and rear sides in a front-to-back direction with a receiving cavity located in the front side and forwardly communicating with an exterior in said front-to-back direction;

a row of upper contacts configured to be forwardly assembled into the housing, each of said upper contacts defining an upper contacting section exposed in an upper region of the receiving cavity, and a rear mounting section around said rear side of the housing;

a row of lower contacts configured to be forwardly assembled into the housing, each of said lower contacts defining a lower contacting section exposed in a lower region of the receiving cavity, and a front mounting section around said front side; and an insulative spacer configured to be upwardly, along a vertical direction perpendicular to said front-to-back direction, assembled to the housing around an underside of the housing; wherein each of said lower contacts defines a bridge portion between the lower contacting section and the front mounting section, and a part of said bridge portion is located on said underside of the housing to be sandwiched between the spacer and the housing in said vertical direction.

8. The electrical connector as claimed in claim 7, wherein the spacer defines structures to regulate the corresponding rear mounting sections of the upper contacts.

9. The electrical connector as claimed in claim 8, wherein the spacer includes a vertical section with said structures to regulate the corresponding rear mounting sections of the upper contacts.

10. The electrical connector as claimed in claim 9, wherein each of said first contacts defines a bridge section between the corresponding upper contacting section and the rear mounting section, to abut against the vertical section of the spacer.

11. The electrical connector as claimed in claim 10, wherein the vertical section of the spacer is located between another part of the bridge portion of the second contact and the bridge section of the first contact in said front-to-back direction.

12. The electrical connector as claimed in claim 10 wherein said bridge section of the first contact is straight while the bridge portion of the second contact is L-shaped.

13. The electrical connector as claimed in claim 8, wherein said structures are grooves side by side arranged with one another in a transverse direction perpendicular to both said vertical direction and said front-to-back direction.

14. The electrical connector as claimed in claim 7, wherein said spacer includes a horizontal section to upwardly abut against said parts of the bridge portions of the second contacts in said vertical direction.

15. The electrical connector as claimed in claim 7, wherein both the front mounting section and the rear mounting section are of surface mounting type while extending in an opposite way along said front-to-back direction.

16. The electrical connector as claimed in claim 7, wherein said spacer is of an L-shaped configuration with a vertical segment located between the first contacts and the second contacts in the front-to-back direction, and a horizontal segment located between the underside of the housing and the printed circuit board.

17. The electrical connector as claimed in claim 16, wherein a plurality of grooves side by side arranged with one another along the transverse direction perpendicular to both said front-to-back direction and said vertical direction, are formed on both said vertical segment and said horizontal segment.

18. The electrical connector as claimed in claim 7, wherein disregarding the rear mounting section, remaining portions of the first contact defines roughly an L-shaped configuration while disregarding the front mounting section remaining portions of the second contact defines roughly a U-shaped configuration.

* * * * *